US007018303B2

(12) United States Patent
Yamamoto

(10) Patent No.: US 7,018,303 B2
(45) Date of Patent: Mar. 28, 2006

(54) GOLF CLUBHEAD

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 75 days.

(21) Appl. No.: 10/246,668

(22) Filed: Sep. 19, 2002

(65) Prior Publication Data

US 2003/0064823 A1 Apr. 3, 2003

(30) Foreign Application Priority Data

Sep. 28, 2001 (JP) ..... 2001-302381

(51) Int. Cl.
*A63B 53/04* (2006.01)
*A63B 53/06* (2006.01)

(52) U.S. Cl. ..... 473/329; 473/342

(58) Field of Classification Search ..... 413/330, 413/331, 342, 325, 329, 340
See application file for complete search history.

(56) References Cited

U.S. PATENT DOCUMENTS 5,282,624 A * 2/1994 Viste ..... 473/342
6,299,548 B1 * 10/2001 Lin ..... 473/331
6,508,722 B1 * 1/2003 McCabe et al. ..... 473/330
2002/0189356 A1 * 12/2002 Bissonnette et al. ..... 73/570
2003/0181257 A1 * 9/2003 Yamamoto ..... 473/342
2003/0195058 A1 * 10/2003 Rice et al. ..... 473/329
2003/0199335 A1 * 10/2003 Bissonnette et al. ..... 473/342

FOREIGN PATENT DOCUMENTS

| | | | |
|---|---|---|---|
| JP | A-9-168613 | | 6/1997 |
| JP | A-9-192273 | | 7/1997 |
| JP | A-10-137372 | | 5/1998 |
| JP | B2-2813969 | | 8/1998 |
| JP | A-11-216204 | | 8/1999 |
| JP | 2002239040 A | * | 8/2002 |
| JP | 2002253709 A | * | 9/2002 |

* cited by examiner

*Primary Examiner*—Gregory Vidovich
*Assistant Examiner*—Alvin A. Hunter, Jr.
(74) *Attorney, Agent, or Firm*—Birch, Stewart, Kolasch & Birch, LLP

(57) ABSTRACT

A golf clubhead comprises a face portion having a back surface which is provided around a center region with at least two annular grooves so that the face portion is provided with at least two annular thin parts each being thinner than the center region and at least one rib part between the thin parts, whereby the rebound performance and durability of the face portion can be improved.

13 Claims, 8 Drawing Sheets

Ex.2

Ex.5

Ref.1

Ref.2

Ref.3

A=2.2mm B=2.4mm C=2.6mm
D=2.8mm E=2.9mm F=3.0mm

GOLF CLUBHEAD

BACKGROUND OF THE INVENTION

The present invention relates to a golf clubhead more particularly to a face portion being capable of improving the rebound performance and durability.

In recent years, in order to improve the rebound performance of a golf clubhead, decreasing the thickness of the face portion has been proposed and carried out. However, if the thickness is decreased throughout the clubface, the durability of the face portion is liable to decrease. Therefore, decreasing the thickness only in the periphery of the clubface has been proposed. Such propositions can be found in Japanese patent application JP-A-09-192273 and Japanese utility-model application JP-Y-02-29973. In such propositions, however, the rebound performance is, as expected, not good in comparison with the clubface whose thickness is decreased in its entirety, and it is difficult to improve the rebound performance.

SUMMARY OF THE INVENTION

It is therefore, an object of the present invention to provide a golf clubhead in which the face portion is improved in the durability as well as the rebound performance.

According to the present invention, a golf clubhead comprises a face portion which has a back surface provided around a center region thereof with at least two annular grooves so that the face portion is provided with at least two annular thin parts each being thinner than the center region and at least one rib part between the thin parts.

Therefore, the face portion is decreased in the rigidity in a wide periphery region around the center region because a plurality of the annular thin parts are dispersed around the center region, and as a result, the flexure at the time of striking a ball is increased to effectively improve the rebound performance. Further, stress at the time of hitting a ball which stress is liable to concentrate on a thin part is also dispersed, and the magnitude of stress on each annular thin part decreases. Accordingly, the durability can be improved. Further, as the rib parts can reinforce the periphery region, the durability can be further improved. Otherwise, while maintaining the durability, a further decrease in the thickness of the annular thin part becomes possible to improve the restitution coefficient.

DESCRIPTION OF THE PREFERRED EMBODIMENTS

Figure 1:
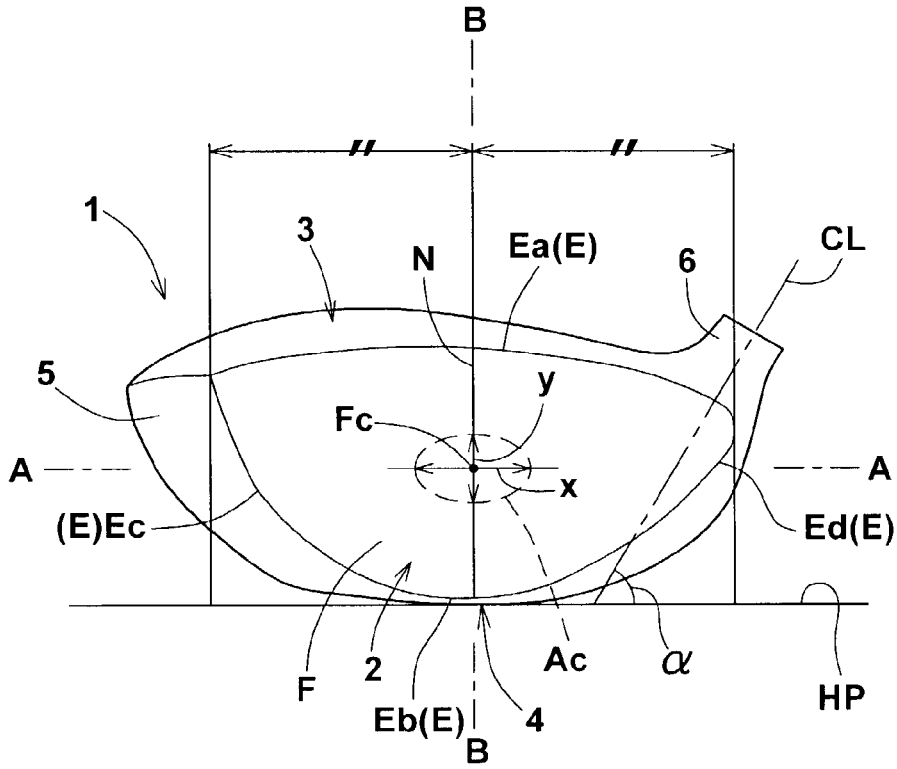
FIG. 1 is a front view of a clubhead according to the present invention.

Embodiment of the present invention will now be described in detail in conjunction with the accompanying drawings.

In the drawings, clubhead 1 according to the present invention comprises a face portion 2 defining a clubface F for hitting a ball, a crown portion 3 defining a top face of the clubhead, a sole portion 4 defining a bottom face of the clubhead or sole, a side portion 5 between the crown portion 3 and sole portion 4, extending from the toe to the heel through the back face to define a side face of the clubhead, and a hosel 6 having an opening for clubshaft.

In this embodiment, the clubhead 1 is a wood-type metal head for a driver (#1).

In FIG. 1, the clubhead 1 is in a measuring state. The measuring state is that the clubhead is, as shown in FIG. 1, set on a horizontal plane HP such that the center line CL of the clubshaft is inclined at the lie angle alpha while keeping the center line CL on a vertical plane, and the clubface F forms its loft angle with respect to the horizontal plane HP.

In the front view (FIG. 1) of the clubhead under the measuring state, the clubface center Fc is defined as a point on the clubface F which is equidistant from the extremities of the upper edge Ea and lower edge Eb of the clubface F in the horizontal direction and also equidistant from the extremities of the toe-side edge Ec and heel-side edge Ed of the clubface F in the vertical direction.

The hosel 6 is provided with a circular hole for inserting the clubshaft which extends towards the inside of the clubhead from the above-mentioned opening. The center line of the shaft-inserting hole can be used instead of the center line CL of the golf clubshaft when setting up the clubhead alone at the lie angle.

The clubhead 1 may be made of metal material such as aluminum alloy, pure titanium, titanium alloy, stainless steel and the like. In this example, the clubhead 1 has a two-piece structure comprising a main body and a sole plate. The main body is composed of the face portion 2, crown portion 3, side portion 5 and hosel 6 and formed by lost-wax precision casting, using an alpha-beta type titanium alloy Ti-6Al-4V. Thus, the main body is hollow center and the bottom is opened, and the sole plate is fixed to the bottom to close the opening and form the sole portion 4. The hollow in this example is filled with air, but it may be filled with a filler other than air, for example, foamed resin. Anyway, the hollow is formed behind the face portion 2.

Aside from the above-mentioned alpha-beta type titanium alloy Ti-6Al-4V, other metal materials such as Ti-4.5Al-3V-2Fe-2Mo and Ti-3Al-2.5V may be used for the head main body. Further, aside from the lost-wax precision casting, other methods such as welding plurality parts into one can be used for forming the head main body.

The face portion 2 is provided on the back surface 7 with annular grooves to provide the face portion with a first annular thin part 9*a* having a thickness (ta), a second annular thin part 9*b* having a thickness (tb) and a third annular thin part 9*c* having a thickness (tc) (hereinafter, generically the "annular thin part 9" and "thickness t"). The thickness (t) is less than the thickness To of a center region Ac which is defined as being surrounded and enclosed by the innermost first annular thin part 9*a*. Here, the thickness (t) means the thickness at the thinnest position of the part concerned.

Figure 2:
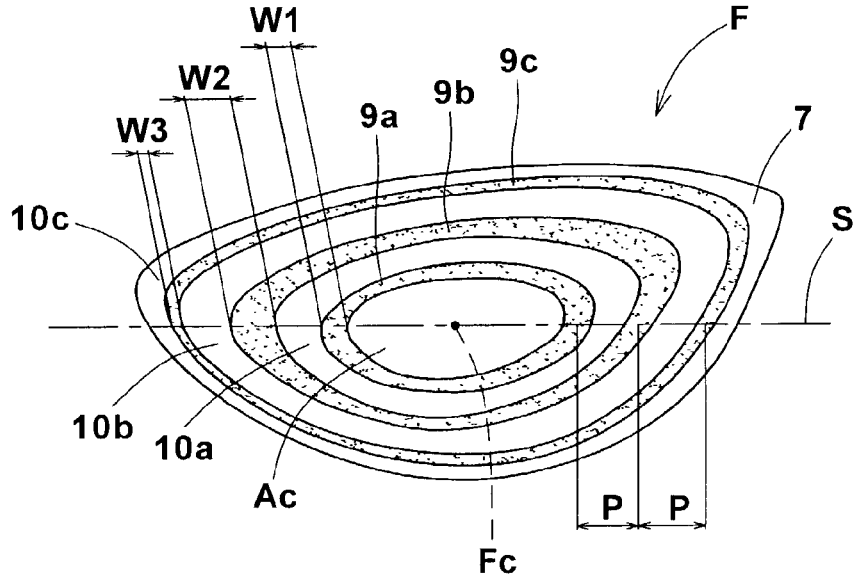
FIG. 2 is a rear view of the face portion thereof.

In this embodiment, as shown in FIG. 2, all the annular thin parts 9 are an oval substantially analogous to the contour of the clubface F. The center region Ac is formed in a substantially oval shape having a minor axis (y) of at least 10 mm long extending in the crown-sole direction and a major axis (x) of at least 20 mm long extending in the toe-heel direction with the origin being at the clubface center Fc. The crown-sole direction means a direction along the clubface F and a vertical plane (B) passing the clubface center Fc. The toe-heel direction means a direction along the clubface F and a horizontal plane (A) passing the clubface center Fc. Such oval shape is preferably used because the oval shape coincides with that of distribution of ball-hitting positions of average golfers. However, other shapes such as circle and rounded rectangle may be used aside from the oval.

On the other hand, by providing the annular grooves, annular rib parts are formed. In this embodiment, the rib parts include: a first rib part 10*a* between the first annular thin part 9*a* and second annular thin part 9*b* having a thickness Ta more than the thickness (ta); a second rib part 10*b* between the second annular thin part 9*b* and third annular thin part 9*c* having a thickness Tb more than the thickness (tb); and a third rib part 10*c* outside the third annular thin part 9*c* having a thickness Tc more than the thickness (tc), (hereinafter the "rib part 10" having the "thickness T".) Here, the thickness T is defined as the thickness at the thickest position of the rib 10. The rib part 10 is continuous and annular.

The number of the annular thin parts 9 is three in this embodiment as described above. If the number is less than two or more than four, it becomes difficult to improve the rebound performance without sacrificing the durability. Therefore, the number is preferably set in a range of from two to four.

Although preferred ranges vary a little depending on the strength of the material, it is preferable to set the thickness (To. T, t) of the face portion 2 as follows.

The center region Ac has a thickness To in a range of from 2.2 to 3.2 mm. More preferably 2.5 to 2.8 mm, in this embodiment, almost constant value of 2.8 mm.

The thickness (ta) is in a range of from 2.1 to 2.8 mm, more preferably 2.4 to 2.6 mm.

The thickness (tb) is not more than, preferably less than the thickness (ta). More specifically, the thickness (tb) is in a range of from 1.8 to 2.5 mm, more preferably 2.1 to 2.3 mm.

The thickness (tc) is not more than, preferably less than the thickness (tb). More specifically, the thickness (tc) is in a range of from 1.5 to 2.2 mm, more preferably 1.8 to 2.0 mm.

Thus, it is preferable that the thickness (t) gradually decreases from the innermost thin part to the outmost thin part.

On the other hand, the thickness T (Ta, Tb, Tc) in this embodiment is the substantially same as the thickness To of the center region Ac, but, it is also possible to gradually change the thickness T from the center towards the periphery of the clubface F such that Ta>Tb>Tc.

If the thickness To is less than 2.2 mm, the center region Ac is liable to be broken by impact force at the time of striking a ball. If the thickness To is more than 3.2 mm, as the face portion becomes rigid in its entirety, it is difficult to improve the rebound performance.

If the thickness (ta), (tb) and (tc) are less than 2.1 mm, 1.8 mm and 1.5 mm, respectively, the face portion 2 is liable to decrease in the durability. If the thickness (ta), (tb) and (tc) are more than 2.8 mm, 2.5 mm and 2.2 mm, respectively, as the rigidity of the face portion 2 can not be effectively reduced, it becomes difficult to improve the rebound performance. Especially, by setting the thickness (t) such as tc<tb and/or tb<ta (namely, the outer thin part is thinner), the durability and rebound performance can be effectively improved in a well-balanced manner.

Further, the intervals P between the annular thin parts 9 are set in a range of from 5 to 20 mm, preferably 5 to 15 mm, more preferably 5 to 10 mm. The intervals P are changed around the clubface center Fc such that the intervals P are larger on the toe-side and heel-side (horizontal direction) but smaller on the crown-side and sole-side (vertical direction). As the intervals P vary around the clubface center Fc, the interval P is defined as the distance measured between the centers of the annular thin parts along a straight line S passing the clubface center Fc—the straight line S may extend in every direction (360 deg.). It is preferable that intervals P along each straight line S extending from the clubface center Fc to the clubface edge (E) are substantially constant, although the widths W are not always constant.

Figure 3A:
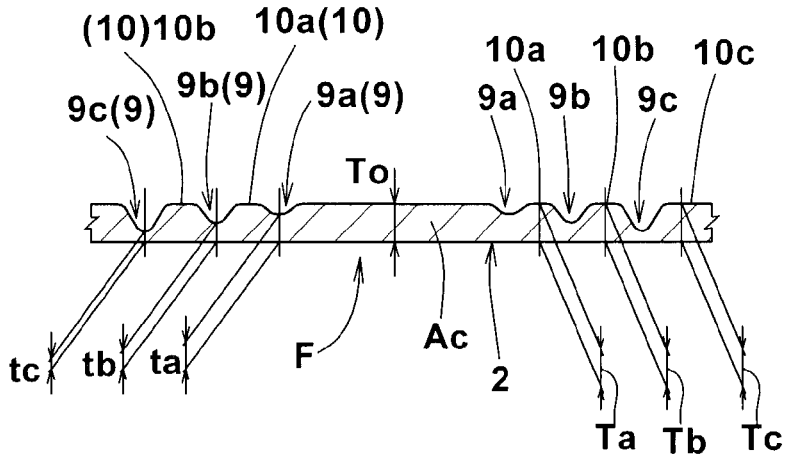
FIG. 3*a* is a cross sectional view of the face portion thereof taken along a line A—A in FIG. 1.
Figure 3B:
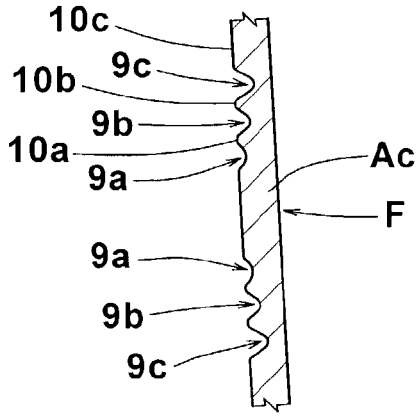
FIG. 3*b* is a cross sectional view of the same face portion taken along a line B—B in FIG. 1.

FIGS. 3*a* and 3*b* show an example of the face portion 2 wherein the thickness of the face portion 2 smoothly changes between the annular thin parts 9 and rib parts 10. In case of short pitch P (in such a direction, for example in the vertical direction), in a cross section of the face portion 2 in such direction, the annular thin parts 9 and rib parts 10 are formed by a curved line like a sine curve as shown in FIG. 3*b*. In case of long pitch P (in such a direction, for example in the horizontal direction), in a cross section of the face portion 2 in such direction, the annular thin parts 9 and rib parts 10 are formed by a curved line like a hybrid of a sine wave and a trapezoidal wave as shown in FIG. 3*a*. specifically, the annular thin parts 9 is a sine wave and the rib part 10 is a trapezoidal wave.

Figure 4:
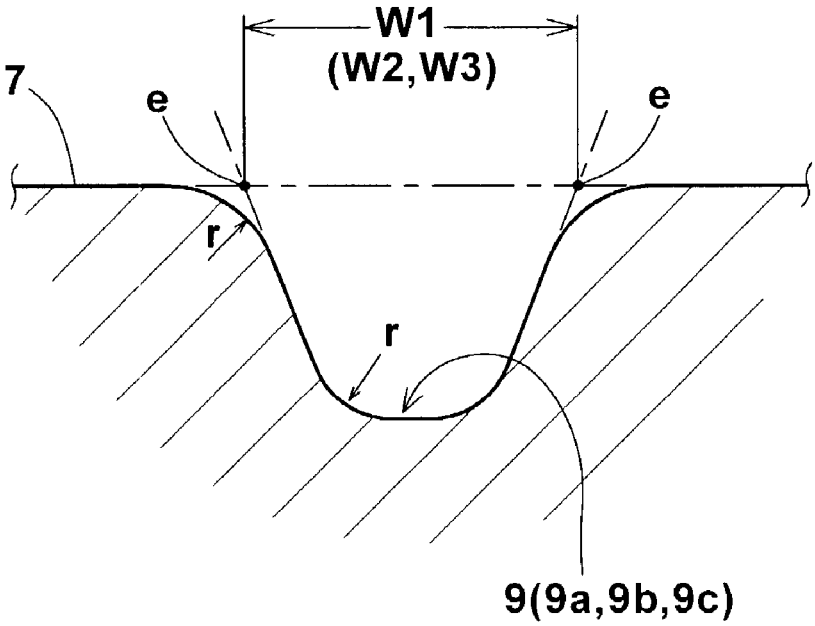
FIG. 4 is an enlarged cross sectional view of an example of the annular thin part.

Further, if the pitch P is more long and the width W is more wide, as shown in FIG. 4, the groove bottom may have a flat part, the groove sidewalls are inclined outside, and the rib part may have a flat part.

Figure 5A:
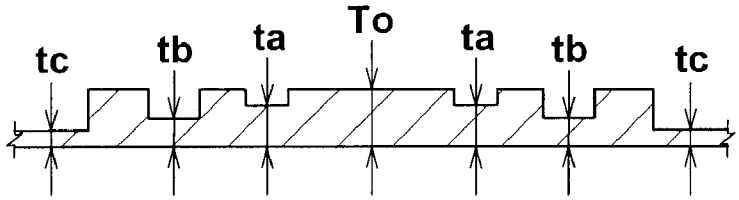
FIGS. 5*a* and 5*b* are cross sectional views of another example of the face portion taken along a line A—A and a line B—B in FIG. 1, respectively.
Figure 5B:
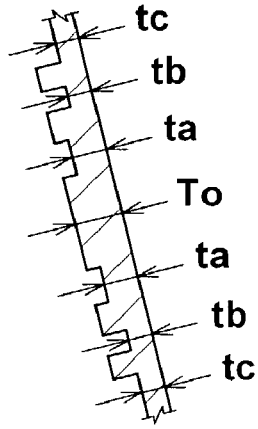

FIGS. 5*a* and 5*b* shows another example of the face portion 2, wherein the change in the thickness of the face portion 2 is stepped contrary to the above-mentioned example. In a cross section of the face portion 2, the annular thin parts 9 and rib parts 10 are formed by a polygonal line like a rectangular wave.

Figure 6A:
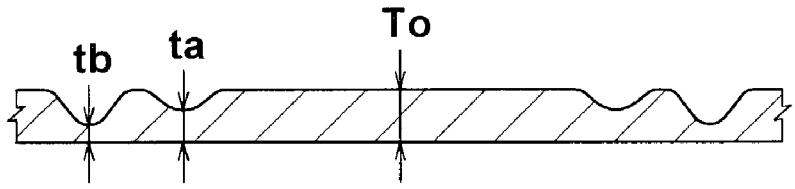
FIGS. 6*a* and 6*b* are cross sectional views of another example of the face portion taken along a line A—A and a line B—B in FIG. 1, respectively.
Figure 6B:
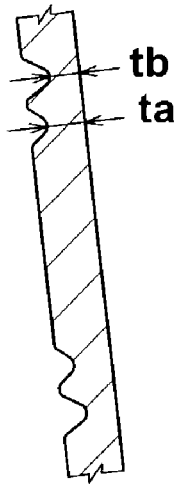

In this embodiment (in the above-mentioned two examples and an example shown in FIGS. 6*a* and 6*b*), the back surface 7 of the face portion 2 is substantially flat in the center region Ac, but form the fringe of the center region Ac, it becomes the wave (sine, hybrid, rectangular) whose amplitude becomes larger towards the edge E of the clubface F.

In any case, from a point of view of durability, it is desirable to round the corners by an arc whose radius (r) is for example about 2.0 to 4.0 mm to avoid stress concentration on the corners as shown in FIG. 4.

Furthermore, as to the width (W) of the annular thin part 9, each annular thin part 9 in this embodiment is wider on the toe-side and heel-side, but narrower on the crown-side and sole-side. And the width changes smoothly or continuously between the wide parts and narrow parts. As the width (W) of the annular thin part 9 vary around the clubface center Fc, the width is defined as being measured along a straight line S passing the clubface center Fc—the straight line may extend in every direction (360 deg.). Further, in case of the rounded corners as shown in FIG. 4, the width (W1,W2,W3) may be defined as a distance between virtual corners (e) between the back surface 7 and groove sidewall.

The width W1 of the first annular thin part 9*a* is preferably set in a range of from 1.7 to 5.4 mm, more preferably 1.9 to 4.8 mm. The width W2 of the second annular thin part 9*b* is preferably set in a range of from 1.5 to 5.4 mm, more preferably 1.3 to 5.0 mm. The width W3 of the third annular thin part 9*c* is preferably set in a range of from 1.3 to 5.0 mm, more preferably 1.5 to 4.0 mm.

If the widths W1, W2 and W3 are less than 1.7 mm, 1.5 mm and 1.3 mm, respectively, it becomes difficult to effectively decrease the rigidity to improve the rebound performance. if the widths W1, W2 and W3 are more than 5.4 mm, 5.4 mm and 5.0 mm, respectively, the face portion 2 is liable to decrease in the durability.

Further, for the purpose of improving the flexibility of the face portion without decreasing the durability, the widths W1, W2 and W3 of the annular thin parts 9*a*, 9*b* and 9*c* may be gradually increased from the center towards the outside (namely, W1<W2<W3). This magnitude relation is mentioned on the widths along the above-mentioned straight line S extending from the clubface center Fc to the edge E of the clubface F.

Comparison Tests

Wood-type golf clubheads having the above-mentioned two-piece structure and a head volume of 305 cc were made and tested for the durability and restitution coefficient. The head main body was an integral molding of an alpha-beta-type titanium alloy Ti-6Al-4V formed by lost-wax precision casting, and the separately formed sole plate was welded to the head main body.

Restitution Coefficient Test

According to the "Procedure for Measuring the Velocity Ratio of a Club Head for Conformance to Rule 4-1e, Appendix II, Revision 2 (Feb. 8, 1999), United States Golf Association.", the restitution coefficient "e" was obtained using the following equation:

$$Vo/Vi=(eM-m)/(M+m)$$

wherein
Vo: ball rebound velocity
Vi: ball incoming velocity
M: the mass of the club head
m: the mass of the ball.

As specified therein, the golf balls used were "Titleist, PINNACLE GOLD" and the radius of the target circle centered on the sweet spot was 5 mm. The distance between the clubface and the launching device was 55 inches, and the incoming ball velocity was 160±0.5 feet/sec.

Durability Test

Golf balls were repeatedly hit against the clubface of the fixed clubhead perpendicularly thereto at a speed of 55 m/s until the face portion was broken to count the number of the hits. The test results are shown in Table 1 together with the specifications of the clubheads.

From the test results, it was confirmed that Examples according to the invention can be improved in the restitution coefficient without deteriorating the durability.

The present invention can be suitably applied to various clubheads such as iron-type and utility-type in addition to the wood-type as far as the clubhead is provided behind the face portion with a hollow irrespective of whether it is opened or closed.

TABLE 1

Figure 7A:
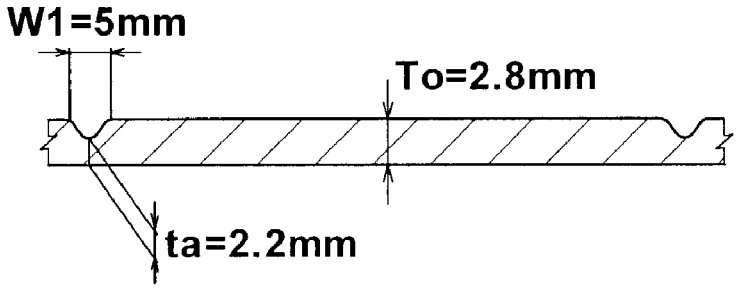
FIGS. 7*a* and 7*b* are cross sectional views of the face portion of a comparative example taken along a line A—A and a line B—B in FIG. 1, respectively.
Figure 7B:
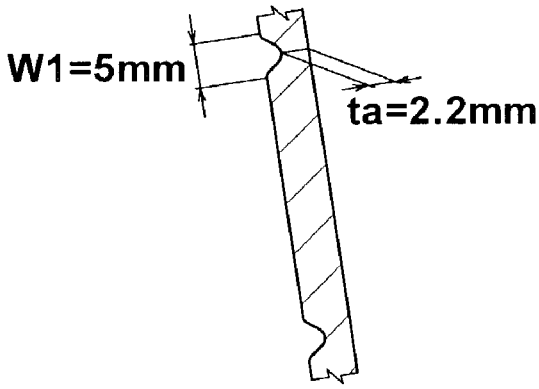
Figure 8A:
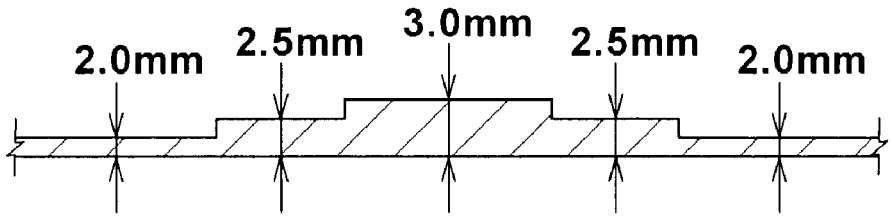
FIGS. 8*a* and 8*b* are cross sectional views of the face portion of another comparative example taken along a line A—A and a line B—B in FIG. 1, respectively.
Figure 8B:
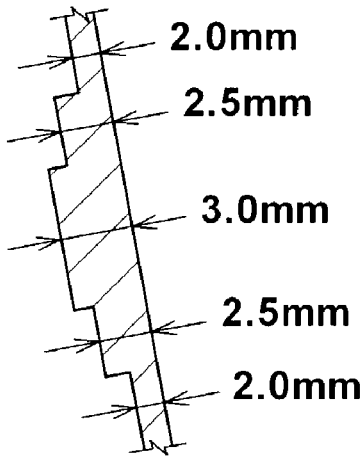
Figure 9A:
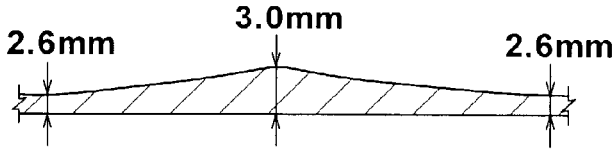
FIGS. 9*a* and 9*b* are cross sectional views of the face portion of another comparative example taken along a line A—A and a line B—B in FIG. 1, respectively.
Figure 9B:
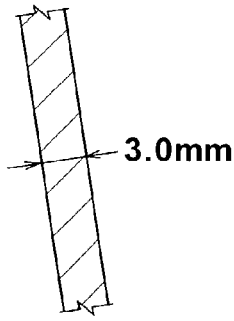
Figure 9C:
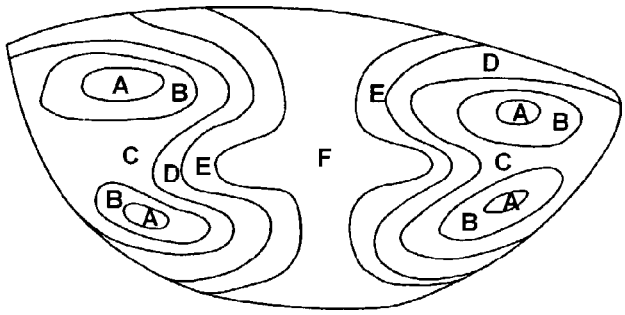
FIG. 9*c* shows the thickness distribution thereof.

| Clubhead Structure | Ex. 1 FIG. 3 | Ex. 2 FIG. 5 | Ex. 3 FIG. 3 | Ex. 4 FIG. 3 | Ex. 5 FIG. 6 | Ex. 6 FIG. 3 | Ex. 7 FIG. 3 | Ex. 8 FIG. 3 | Ref. 1 FIG. 7 | Ref. 2 FIG. 8 | Ref. 3 FIG. 9 |
|---|---|---|---|---|---|---|---|---|---|---|---|
| Center region | | | | | | | | | | | |
| Thickness To (mm) | 2.8 | 2.8 | 2.8 | 2.8 | 2.8 | 2.8 | 2.8 | 2.8 | 2.8 | | |
| Shape | oval | oval | oval | oval | oval | oval | oval | oval | oval | | |
| Length x (mm) | 10 | 10 | 10 | 8 | 22 | 10 | 10 | 10 | 37 | | |
| Length y (mm) | 20 | 20 | 20 | 15 | 61 | 20 | 20 | 20 | 76 | | |
| Annular thin part | | | | | | | | | | | |
| Number | 3 | 3 | 3 | 3 | 2 | 3 | 3 | 3 | 1 | — | — |
| Thickness ta (mm) | 2.5 | 2.5 | 2.2 | 2.5 | 2.5 | 2.0 | 2.4 | 2.6 | 2.2 | | |
| Thickness tb (mm) | 2.2 | 2.2 | 2.5 | 2.2 | 2.5 | 2.2 | 2.1 | 2.3 | — | | |
| Thickness tc (mm) | 2.0 | 2.0 | 2.0 | 2.0 | 2.0 | 2.5 | 1.8 | 2.0 | — | | |
| Distance between 1st and 2nd thin parts | | | | | | | | | | | |
| x-direction (mm) | 11 | 7 | 11 | 9 | 11 | 11 | 11 | 11 | — | | |
| y-direction (mm) | 5 | 5 | 5 | 4 | 5 | 5 | 5 | 5 | — | | |
| Distance between 1st and 2nd rib parts | | | | | | | | | | | |
| x-direction (mm) | 11 | 7 | 11 | 9 | 11 | 11 | 11 | 11 | — | | |
| y-direction (mm) | 5 | 5 | 5 | 4 | 5 | 5 | 5 | 5 | — | | |
| Remarks | smooth thickness change | stepped thickness change | t2 > t3 | smaller center region | | t1 < t2 < t3 | thinner | thicker | conventional | | |

TABLE 1-continued

| Clubhead Structure | Ex. 1 FIG. 3 | Ex. 2 FIG. 5 | Ex. 3 FIG. 3 | Ex. 4 FIG. 3 | Ex. 5 FIG. 6 | Ex. 6 FIG. 3 | Ex. 7 FIG. 3 | Ex. 8 FIG. 3 | Ref. 1 FIG. 7 | Ref. 2 FIG. 8 | Ref. 3 FIG. 9 |
|---|---|---|---|---|---|---|---|---|---|---|---|
| Test Results | | | | | | | | | | | |
| Restitution coefficient | 0.835 | 0.835 | 0.832 | 0.835 | 0.821 | 0.825 | 0.837 | 0.834 | 0.810 | 0.825 | 0.840 |
| Durability | 520 | 200 | 390 | 380 | 600 | 150 | 490 | 550 | 520 | 380 | 120 |

The invention claimed is:

1. A golf clubhead comprising a face portion having a back surface, said back surface provided around a center region thereof with at least two annular grooves so that said face portion is provided with at least two annular thin parts each being thinner than the center region and at least one rib part between the thin parts, wherein between said at least two annular thin parts and said at least one rib part, corners are rounded by an arc having a radius (r) in a range of 2.0 to 4.0 mm so that the thickness of the face portion changes smoothly, and also, in the annular thin parts, corners are rounded by an arc having a radius (r) in a range of 2.0 to 4.0 mm said center region has an oval shape having a minor axis of at least 10 mm extending in a crown-sole direction, and a major axis of at least 20 mm extending in a toe-heel direction, in a cross section of the face portion, said at least two annular thin parts and said at least one rib part are formed by a sine-like curved line in a vertical direction, and in a horizontal direction by a curved line that is a hybrid of a sine wave defined by said at least two annular thin parts and a trapezoidal wave defined by said at least one rib part.

2. A golf clubhead according to claim 1, wherein said face portion is further provided with a rib part around the annular thin part which is outermost in said at least two annular thin parts.

3. The golf club head of claim 2, in which said at least two annular thin parts are three or more annular thin parts, and the annular thin parts are gradually increased in width from the center region towards the periphery of the club face.

4. The golf club head of claim 2, in which said at least two annular thin parts are three or more annular thin parts, and the minimum thicknesses of the respective annular thin parts are gradually decreased from the center region towards the periphery of the club face.

5. The golf club head of claim 2, in which said at least two annular thin parts are three or more annular thin parts, and the minimum thicknesses of the respective annular thin parts are gradually decreased from the center region towards the periphery of the club face, and the annular thin parts are gradually increased in width from the center region towards the periphery of the club face.

6. A golf clubhead according to claim 1, wherein in said at least two annular thin parts, each thin part is thinner than the thin part inwardly adjacent thereto.

7. The golf club head of claim 1, in which the thickness of each rib is approximately equal to the thickness of the center region.

8. The golf club head of claim 7, in which the thickness of an annular thin region nearer the center region is greater than the thickness of an annular thin region nearer the periphery of the club face.

9. The golf club head of claim 1, having at least three annular thin regions separated by at least two ribs, in which the thickness of a rib nearer the center of the club face is greater than the thickness of a rib nearer the periphery of the club face.

10. The golf club head of claim 9, in which the thickness of an annular thin region nearer the center region is greater than the thickness of an annular thin region nearer the periphery of the club face.

11. The golf club head of claim 1, in which said at least two annular thin parts are three or more annular thin parts, and the annular thin parts are gradually increased in width from the center region towards the periphery of the club face.

12. The golf club head of claim 1, in which said at least two annular thin parts are three or more annular thin parts, and the minimum thicknesses of the respective annular thin parts are gradually decreased from the center region towards the periphery of the club face.

13. The golf club head of claim 1, in which said at least two annular thin parts are three or more annular thin parts, and the minimum thicknesses of the respective annular thin parts are gradually decreased from the center region towards the periphery of the club face, and the annular thin parts are gradually increased in width from the center region towards the periphery of the club face.

* * * * *